US005542543A

United States Patent [19]

Yasukuni

[11] Patent Number: 5,542,543

[45] Date of Patent: Aug. 6, 1996

[54] ELECTROSTATIC SEPARATION AND CLASSIFICATION APPARATUS

[75] Inventor: Jun Yasukuni, Yokkaichi, Japan

[73] Assignee: Sumitomo Wiring Systems, Ltd., Japan

[21] Appl. No.: 319,931

[22] Filed: Oct. 7, 1994

[30] Foreign Application Priority Data

Oct. 20, 1993 [JP] Japan ..... 5-285626

[51] Int. Cl.[6] ..... B03C 7/00

[52] U.S. Cl. ..... 209/127.1; 209/127.4; 209/128

[58] Field of Search ..... 209/127.1, 127.4, 209/128, 129, 130, 131

[56] References Cited

U.S. PATENT DOCUMENTS

| | | | |
|---|---|---|---|
| 924,032 | 6/1909 | Blake et al. | 209/127.4 X |
| 1,222,305 | 4/1917 | Kraus | 209/127.4 X |
| 2,174,681 | 10/1939 | Bartlett | 209/127.4 X |
| 2,217,444 | 10/1940 | Hill | 209/127.4 X |
| 2,428,224 | 9/1947 | Johnson et al. | 209/127.1 X |
| 3,031,079 | 4/1962 | Boss | 209/128 |
| 3,970,546 | 7/1976 | Webb et al. | 209/128 X |
| 4,341,744 | 7/1982 | Brison et al. | 209/128 X |
| 4,797,201 | 1/1989 | Küppers et al. | 209/129 X |

FOREIGN PATENT DOCUMENTS

| | | | |
|---|---|---|---|
| 598948 | 6/1934 | Germany . | |
| 1174274 | 11/1962 | Germany . | |
| 498042 | 3/1976 | U.S.S.R. | 209/131 |
| 6336 | of 1913 | United Kingdom . | |

*Primary Examiner*—David H. Bollinger
*Attorney, Agent, or Firm*—Jordan B. Bierman; Bierman and Muserlian

[57] ABSTRACT

There is disclosed an electrostatic separation and classification apparatus (20) which includes a pair of electrode unit mechanisms (21, 22) having spaced electrodes (28, 29), insulative endless belts (30, 31) covering opposite surfaces of the electrodes (28, 29) and opposed to each other for feeding in circulation, and deposit scratching members (38, 39) remote from a position in which an electrostatic field produced between the electrodes (28, 29) works and in contact with outer surfaces of the endless belts (30, 31) throughout their width, respectively, thereby increasing the rate of operation and safety.

10 Claims, 8 Drawing Sheets

ELECTROSTATIC SEPARATION AND CLASSIFICATION APPARATUS

BACKGROUND OF THE INVENTION

1. Field of the Invention

The present invention relates to an electrostatic separation and classification apparatus for separating and classifying a mixture of powders and/or particles of resin, rubber and the like in accordance with material types.

2. Description of the Prior Art

This type of electrostatic separation and classification apparatus includes an apparatus which makes use of frictional electrification and electrostatic field. For instance, an apparatus shown in FIG. 7 comprises a pair of opposed electrodes 1, 2 disposed in predetermined spaced relation, a charged material-to-be-classified supply portion 3 disposed above spacing between the electrodes 1 and 2, and a collecting portion 4 disposed below spacing between the electrodes 1 and 2.

A high voltage is applied between the electrodes 1 and 2 to produce an electrostatic field therebetween. In this state, a mixture of powders and/or particles of previously charged resin, rubber and the like is supplied from the supply portion 3 into the electrostatic field.

The powders and/or particles of the mixture falling downward by gravity are attracted to the electrodes of their opposite polarities and drop while separated from each other in rightward and leftward directions and are then collected in the collecting portion 4 having partition walls 4*a* and 4*b* in such a manner as to be classified depending upon different fall positions.

Such an apparatus includes an apparatus of the type having vertically extending, parallel opposed flat electrodes which is disclosed by Kali and Salz Entsorgung in Germany. (See "Nikkei New Material", Nov. 16, 1992, pp. 32–33.)

Another apparatus shown in FIG. 8 comprises a drum 6 rotating in a predetermined direction and a rotary electrode 7 obliquely above and spaced apart from the drum 6. The apparatus of FIG. 8 is adapted such that a charged mixture is supplied from a charged material-to-be-classified supply portion 8 above the drum, and the mixture falling in the electrostatic field between the drum 6 and the rotary electrode 7 is separated and classified into attracted, repelled, and intermediate materials in accordance with differences in polarity of the charged powders and/or particles of the mixture.

In FIG. 8, the reference numerals 9 and 10 designate separating plates, 11 and 12 designate collecting containers, 13 designates a scratching piece, and 14 designates a guide element.

However, in the prior art structure of FIG. 7, fine powder of the mixture and dust attracted by static electricity adhere on surfaces of the electrodes I and 2 during continuous operation of the apparatus.

Such deposits, if left as they are, irregularly drop in lumps by vibration generated when the mixture particles strike the electrodes 1, 2 and mechanical vibration of an exterior feeder, and are mixed with the powders and/or particles classified in the collecting portion 4, which may result in deterioration of separation accuracy and charge accumulation that induces ignition.

Thus, it is necessary to stop operating the apparatus for maintenance which includes scratching off or knocking away the deposits adhering on the surfaces of the electrodes 1, 2 at regular and frequent intervals. This has caused a decreased rate of operation.

In the maintenance, an operator is required to scratch off or knock away the deposited fine powder and dust from the surfaces of the electrodes 1 and 2 and might touch the exposed electrodes in high-voltage or charge-accumulated positions, resulting in a strong likelihood of electric shock.

Similarly, the prior art structure of FIG. 8 is required to stop operating the apparatus when the deposits on the surface of the rotary electrode 7 are scratched off or knocked away. This results in a decreased rate of operation and a strong likelihood of electric shock during the maintenance in the event of a failure because of the exposed surface of the rotary electrode 7.

SUMMARY OF THE INVENTION

The present invention is intended for an apparatus for separating and classifying powders and/or particles by using different fall positions depending upon difference in polarity of the powders and/or particles which are charged. According to the present invention, the apparatus comprises: a pair of spaced electrodes for producing an electrostatic field therebetween; insulative endless belts covering respective opposite surfaces of the electrodes and opposed to each other for feeding in circulation; and deposit scratching members remote from a position in which the electrostatic field produced between the electrodes works and contacting outer surfaces of the endless belts throughout their width, respectively.

According to the present invention, when the charged powders and/or particles fall downward in the electrostatic field produced between the electrodes, the powders and/or particles are attracted to the electrodes of their opposite polarities in accordance with differences in polarity thereof and drop while being separated and are classified as desired.

By feeding the endless belts in circulation during the operation of the electrostatic separation and classification, the deposit scratching members scratch off the deposits such as fine powder and dust adhering on the outer surfaces of the endless belts.

Therefore, the endless belt surfaces are always clean, and the ability of classification is prevented from decreasing due to mixed fine powder and dust. Maintenance for regular deposit removal is not required, and the rate of operation of the apparatus is increased.

If the speed of deposition of the fine powder and dust is not very high, the endless belts are not required to be continuously fed but may be fed at regular intervals each time the fine powder and dust are accumulated, thereby reducing running costs in equipment operation.

Further, the respective opposite surfaces of the electrodes are covered with the insulative endless belts, and charged materials such as fine powder and dust deposited on the endless belt surfaces are removed clean. Hence, there is a smaller possibility of electric shock to human bodies, and safety is improved.

It is an object of the present invention to provide an electrostatic separation and classification apparatus which is increased in rate of operation and in safety.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
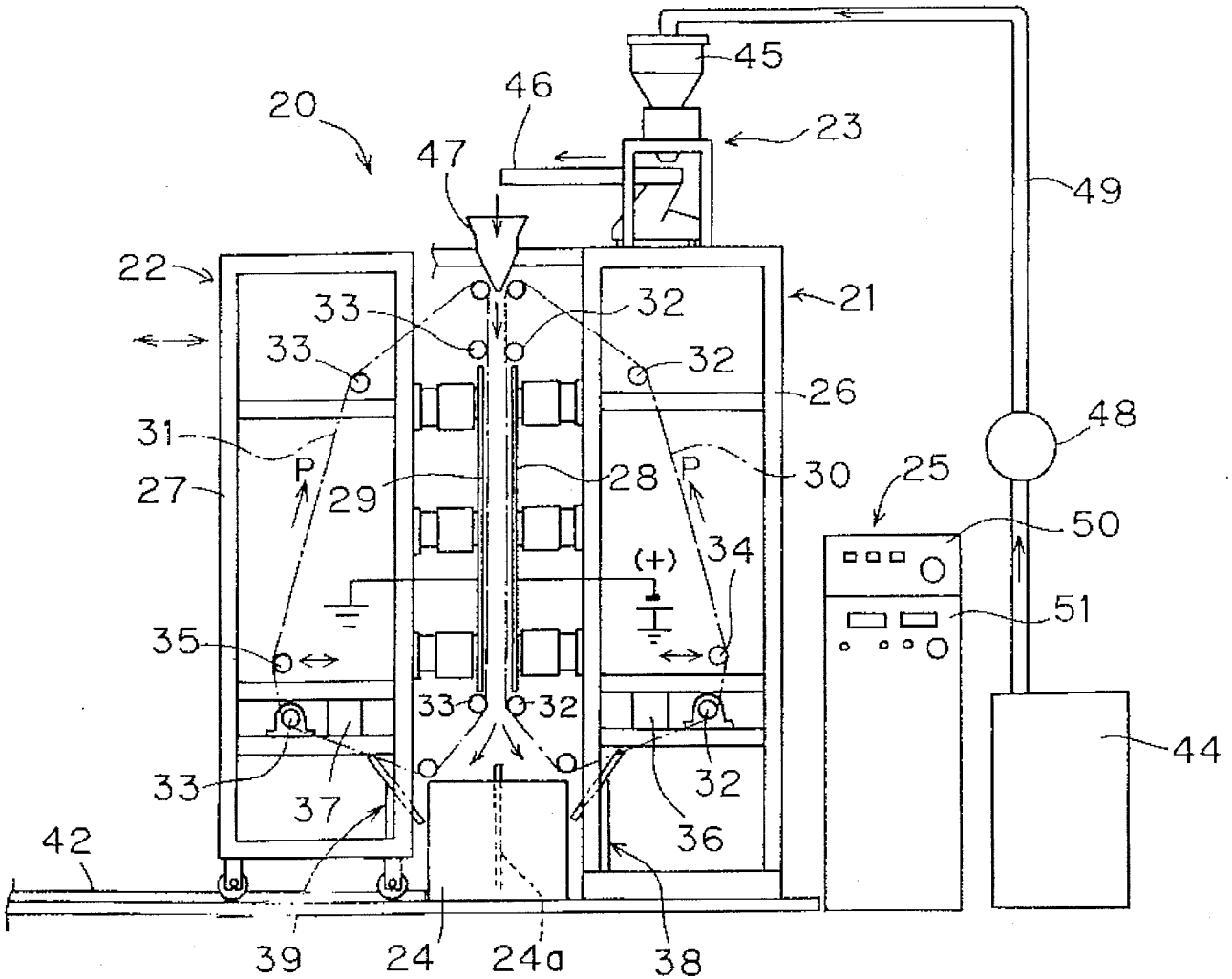
FIG. 1 is a front elevation of a first preferred embodiment according to the present invention.
Figure 2:
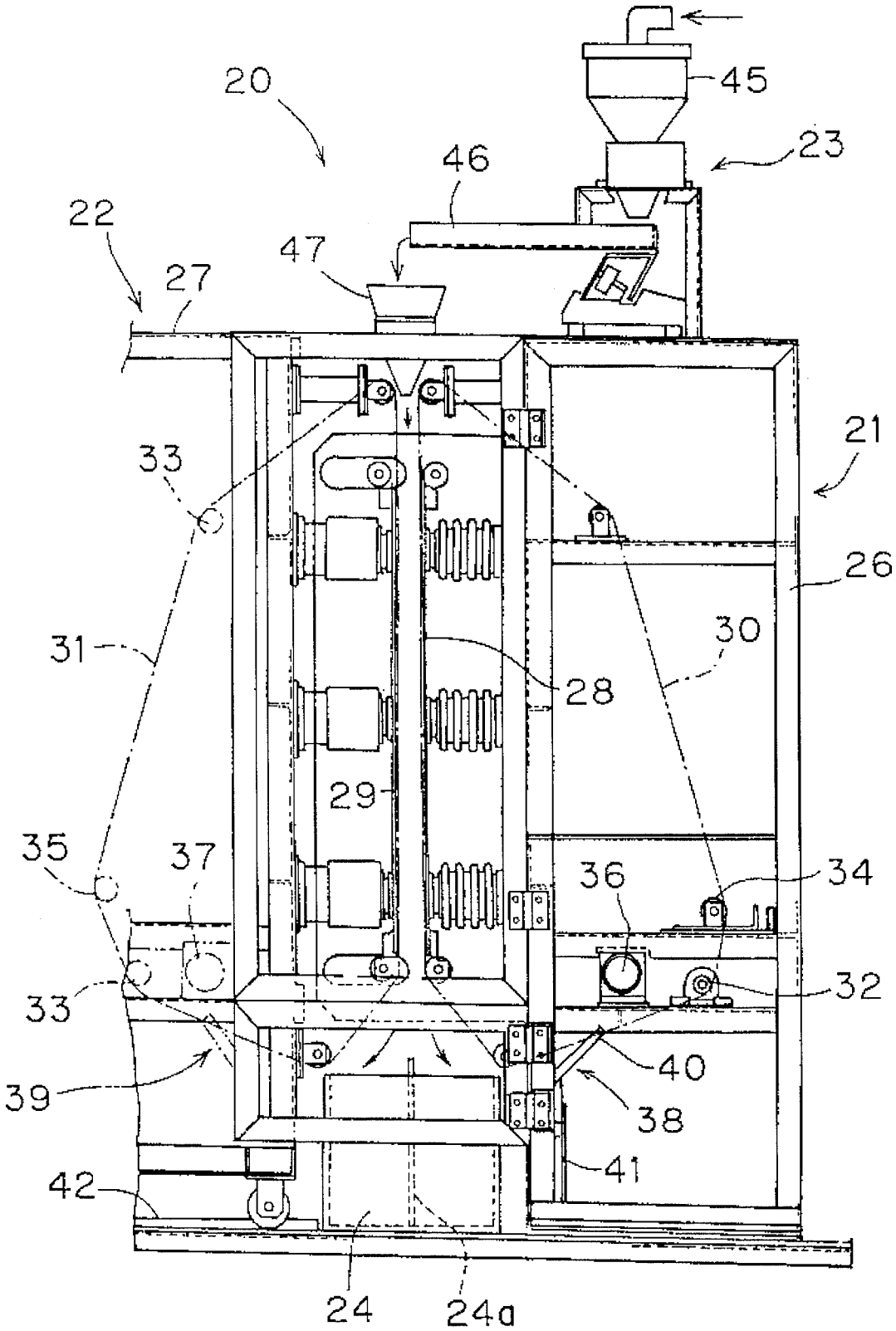
FIG. 2 is a partially enlarged view of the first preferred embodiment.
Figure 3:
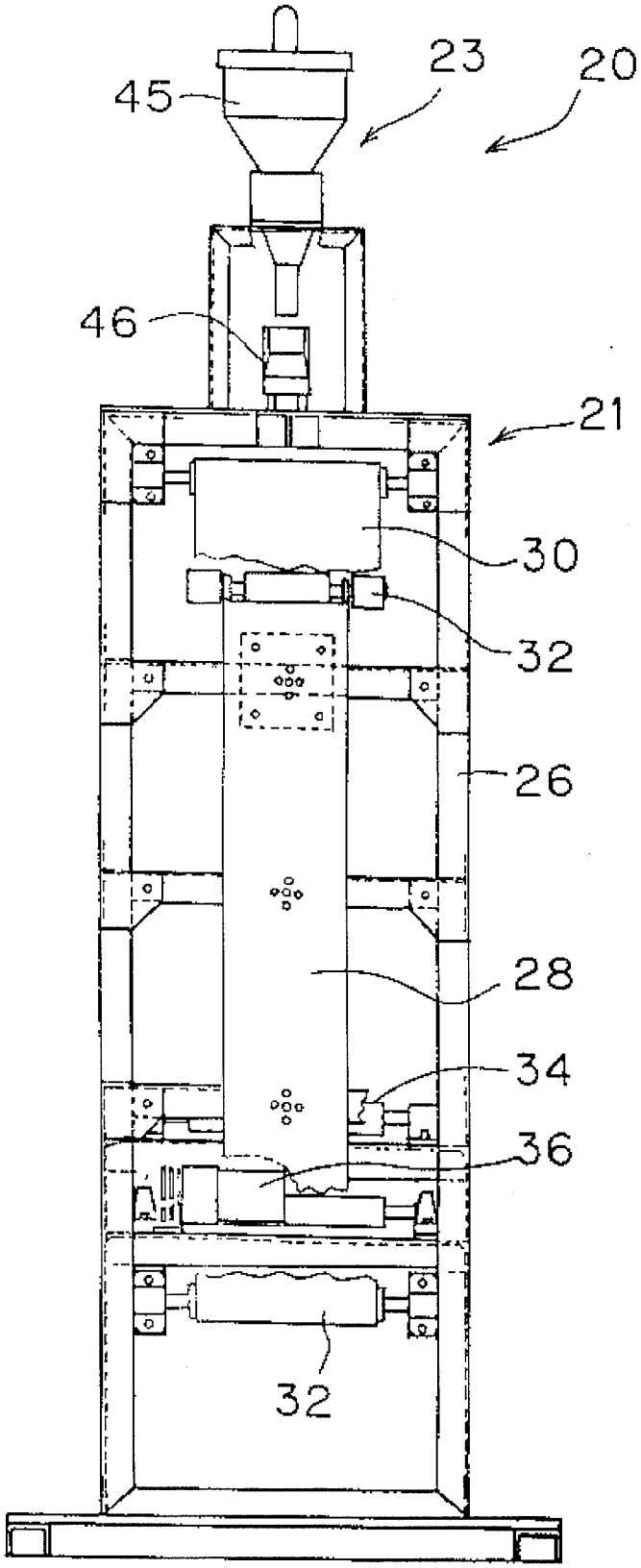
FIG. 3 is a partial left side elevation of the first preferred embodiment.

A first preferred embodiment according to the present invention will now be described with reference to the drawings. As shown in FIGS. 1 to 5, an electrostatic separation and classification apparatus 20 comprises a pair of fight and left electrode unit mechanisms 21 and 22, a material-to-be-classified supply mechanism 23 for supplying a mixture of powders and/or particles to a predetermined position, a recovery container 24 for collecting the separated and classified powders and/or particles, and a controller 25.

The electrode unit mechanisms 21 and 22 are substantially symmetrical and include support frames 26, 27 of angle bars and the like, electrodes 28, 29 extended from opposed surfaces of the support frames 26, 27 in predetermined spaced, opposed relation to each other and mounted on and supported by the support frames 26, 27, and insulative endless belts 30, 31 covering the opposed surfaces of the electrodes 28, 29 and opposed to each other for feeding in circulation. The endless belts 30, 31 should have an insulation resistance of 100 MΩcm or more.

The endless belts 30, 31 are supported by and trained around a plurality of guide rollers 32, 33 rotatably supported by the support frames 26, 27, and are suitably tensioned by tension rollers 34, 35 supported for laterally adjustable movement by the support frames 26, 27, respectively. The opposed surfaces of the electrodes 28, 29 are slightly spaced apart from the endless belts 30, 31, respectively.

Respective one of the plurality of guide rollers 32, 33 is driven for rotation through drive motors 36, 37 mounted on and supported by the support frames 26, 27 and a transmission mechanism including a transmission belt mechanism, to feed the endless belts 30, 31 in circulation in the directions of the arrow P. The drive motors 36, 37, the transmission mechanism, and the like form a drive mechanism.

Figure 4:
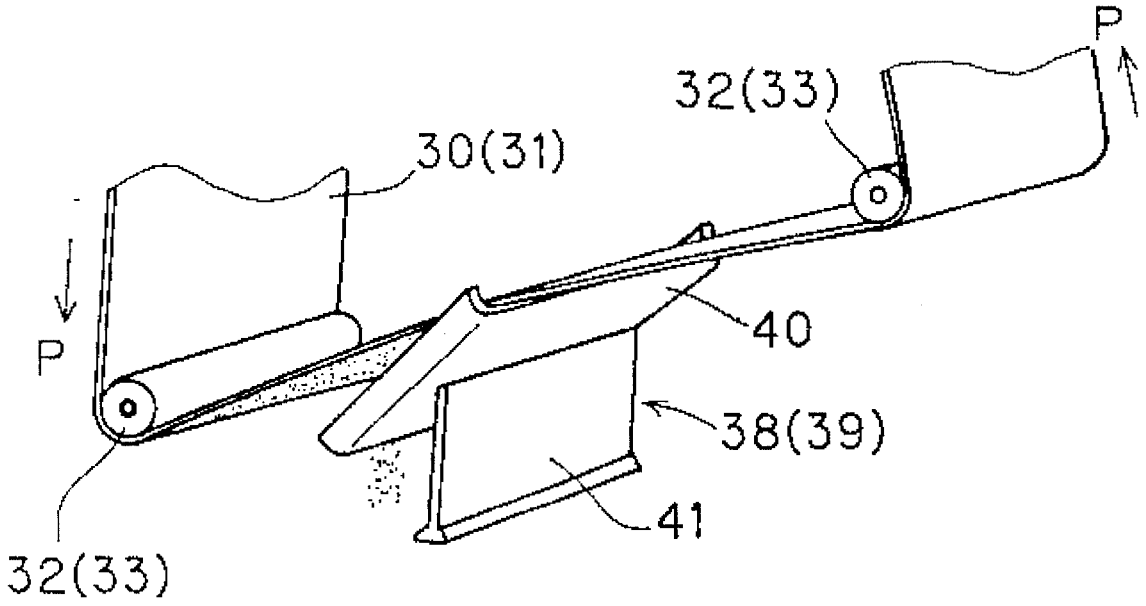
FIG. 4 is a partially enlarged perspective view of the first preferred embodiment.
Figure 5:
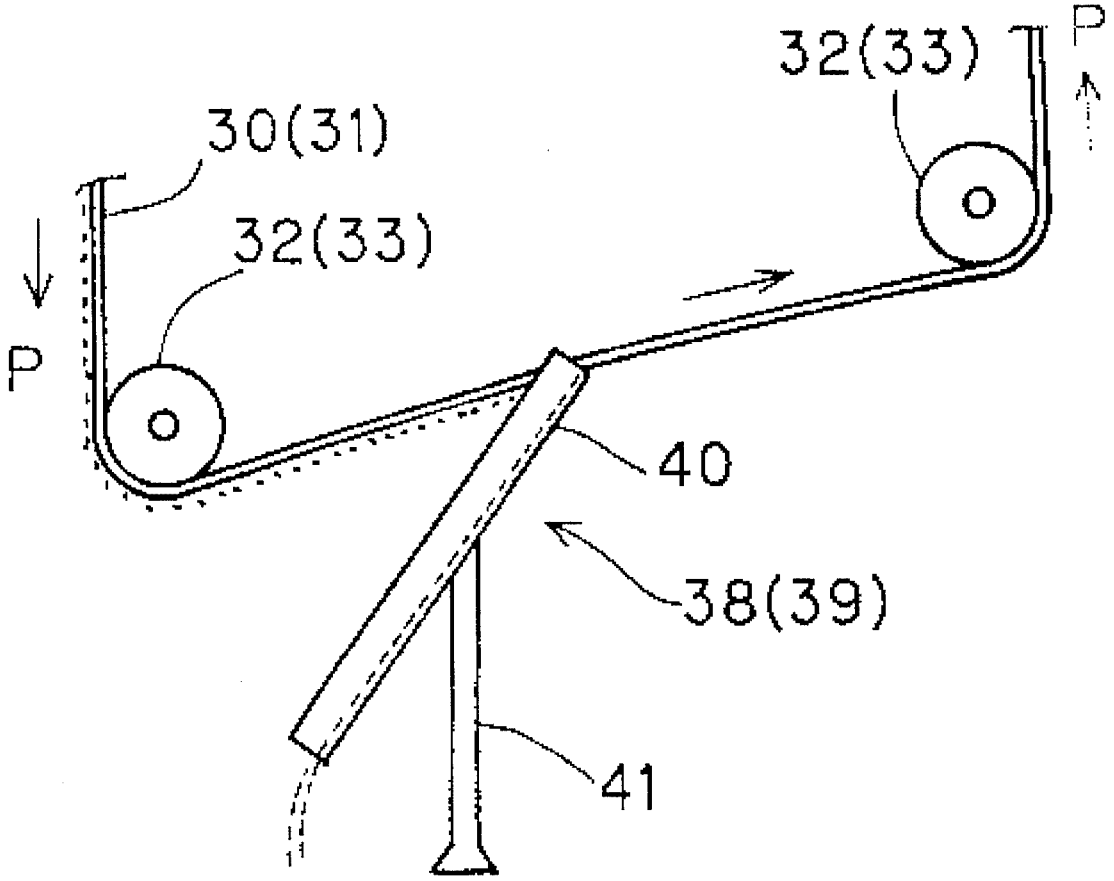
FIG. 5 is a partially enlarged front elevation of the first preferred embodiment.

Deposit scratching members 38, 39 are provided in lower portions of the support frames 26, 27 remote from a position in which the electrostatic field produced between the electrodes 28 and 29 works. Referring to FIGS. 4 and 5, the deposit scratching members 38, 39 include deposit scratching pieces 40 of metal plates in pressure or resilient contact with portions of the endless belts 30, 31 in which the outer surfaces of the endless belts 30, 31 face downward throughout their width orthogonal to the feeding direction thereof, and support bases 41 for supporting the deposit scratching pieces 40, respectively. The support bases 41 are mounted on the support frames 26, 27 in predetermined positions, respectively.

The support frame 27 is placed for lateral movement along a guide rail 42 toward and away from the support frame 26.

Figure 7:
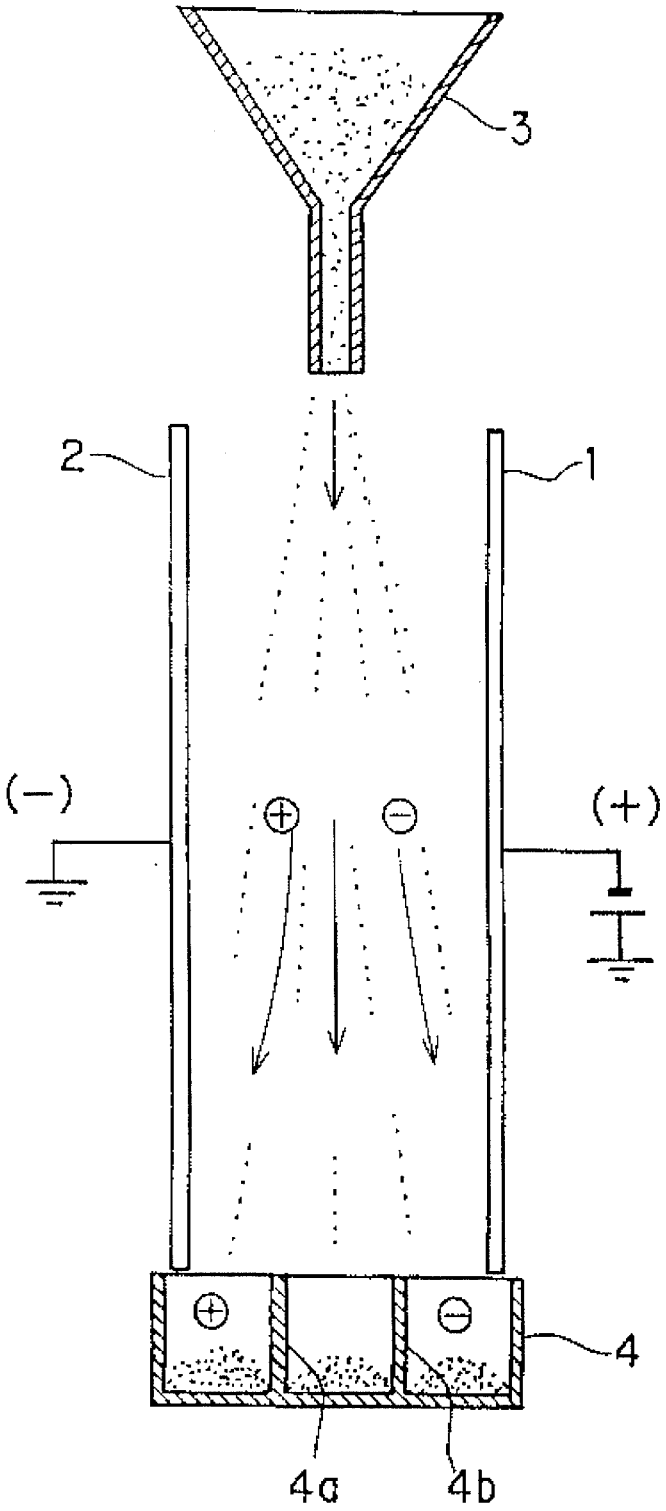
FIGS. 7 and 8 illustrate the prior art.

The recovery container 24 is removably provided under the electrodes 28, 29 of the electrode unit mechanisms 21, 22. The recovery container 24 includes a partition plate **24*a* in the lateral middle thereof for partitioning the interior space into right-hand and left-hand spaces. It should be noted that two or more partition plates 24*a*** may be provided as shown in FIG. 7.

The material-to-be-classified supply mechanism 23 includes a material-to-be-classified 'containing tank 44 for accommodating previously charged powders and/or particles, a hopper 45 above the support frame 26 of the fixed electrode unit mechanism 21, a vibratory feeder 46, a material-to-be-classified supply opening portion 47 over the electrodes 28, 29, and a supply pipe mechanism 49 for sucking in the powders and/or particles in the tank 44 by a suction blower 48 to supply the powders and/or particles to the hopper 45.

The controller 25 includes a high-voltage power supply controller 50 for controlling the voltage of the electrodes 28, 29, and a belt drive controller 51 for controlling the feed of the endless belts 30, 31.

Scattering preventing plates which are transparent plates or the like are suitably provided either fixedly or openably in front and rear positions of the electrodes 28, 29, that is, in front and rear positions of the endless belts 30, 31 to prevent forward and rearward scattering of the powders and/or particles.

The first preferred embodiment of the present invention is constructed as above described. When the electrostatic separation and classification apparatus 20 is used, the high-voltage power supply controller 50 is operated to apply high voltage to the electrode 28, with the electrode 29 grounded. This causes an electrostatic field to be produced between the electrodes 28 and 29. The belt drive controller 51 is operated to feed the endless belts 30 and 31 at very low speeds in the directions of the arrow P.

The mixture of previously charged powders and/or particles are accommodated in the tank 44. The mixture may be a simple two-component mixture such as mixed pellets comprising polyvinyl chloride (PVC) and polypropylene (PP), and otherwise various multicomponent mixtures. An example of the multicomponent. mixtures is a mixture (known as nugget waste) of resin, rubber, and the like remaining after copper conductors are recovered from disassembled used wires, cables and wiring harnesses.

Upon operation of the suction blower 48, the mixture of the powders and/or particles in the tank 44 is sucked and supplied into the hopper 45 through the supply pipe mechanism 49. The mixture of the powders and/or particles in the hopper 45 is fed to one end of the vibratory feeder 46 and is then guided to the other end thereof above the supply opening portion 47 by the vibration of the vibratory feeder 46. The mixture then falls into the supply opening portion 47, and drops and is fed from a supply opening at the bottom end of the supply opening portion 47 into the electrostatic field between the endless belts 30 and 31, that is, between the electrodes 28 and 29.

During the drop of the powders and/or particles by gravity, the charged powders and/or particles are attracted to the electrodes 28, 29 of their opposite polarities in accordance with differences in polarities thereof, and fall downward while being separated from each other in rightward and leftward directions, and are then collected in such a manner as to be classified into right-hand and left-hand spaces of the underlying recovery container 24 by the partition plate **24*a***.

Deposits such as very fine powder and dust adhere on the outer surfaces of the endless belts 30, 31 but are scratched off by the deposit scratching pieces 40 under and remote from the position in which the electrostatic field works while the endless belts 30, 31 are fed.

Hence, the surfaces of the endless belts 30, 31 are constantly cleaned to prevent the ability of classification from decreasing due to mixed fine powder and dust and require no maintenance for regular deposit removal. This increases the rate of operation of the electrostatic separation and classification apparatus 20 without the need for frequently stopping the operation of the apparatus 20 for the deposit removal maintenance.

Further, the opposite surfaces of the electrodes 28, 29 are covered with the insulative endless belts 30, 31, and the charged materials such as fine powder and dust deposited on the surfaces of the endless belts 30, 31 are removed clean. Hence, there is a smaller possibility of electric shock to human bodies in equipment check or other maintenance, and safety is enhanced.

When the speed of deposition of the fine powder and dust is not so high, the endless belts 30, 31 are not required to be continuously fed but may be driven for feeding at regular intervals each time the fine powder and dust are accumulated. This reduces running costs in equipment operation.

The deposit scratching members 38, 39 may be located adjacent the electrostatic field if the deposits scratched off by the deposit scratching pieces 40 are permitted to mix with the materials separated and classified in the electrostatic field. Conversely, the deposit scratching members 38, 39 should be located remote from the electrostatic field if mixing the deposits with the classified materials gives rise to trouble, for example when the deposits are discarded as waste.

Figure 6:
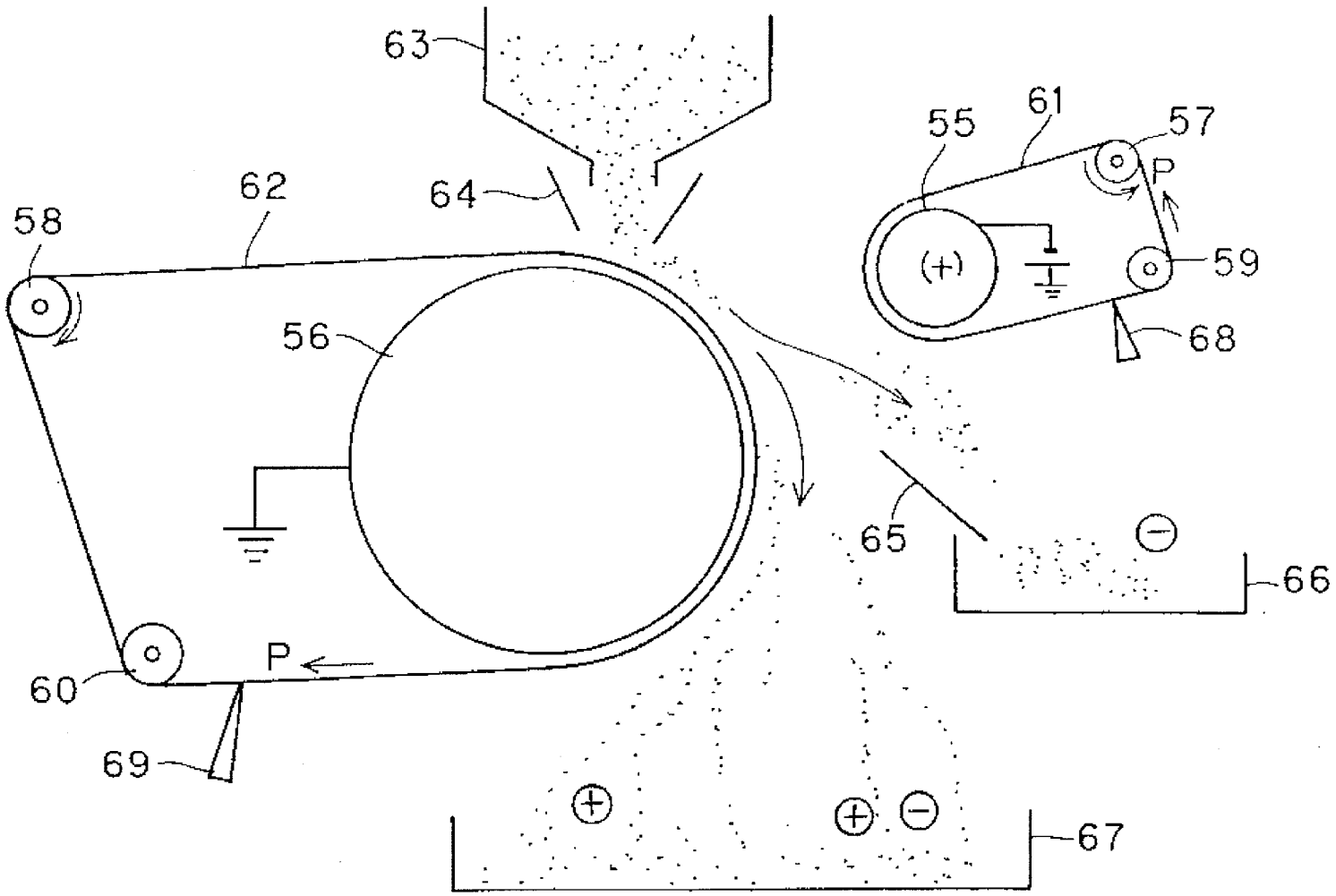
FIG. 6 illustrates a second preferred embodiment according to the present invention.

FIG. 6 illustrates a second preferred embodiment wherein the present invention is applied to a drum type apparatus disclosed in the prior art. Referring to FIG. 6, the apparatus comprises a high-voltage electrode 55, a grounded electrode 56, drive rollers 57, 58 driven suitably, and guide rollers 59, 60. Insulative endless belts 61, 62 are tensioned over the electrodes 55, 56, the drive rollers 57, 58, and the guide rollers 59, 60. The drive rollers 57, 58 are driven to feed the endless belts 61, 62 in circulation in the directions of the arrow P.

The reference numeral 63 designates a charged material-to-be-classified supply portion, 64 designates a guide element, 65 designates a separating plate, 66, 67 designate recovery containers, and 68, 69 designate deposit scratching members.

The mixture of powders and/or particles supplied from the supply portion 63 is separated and classified while sliding down along the slope of the endless belt 62 by gravity.

Figure 8:
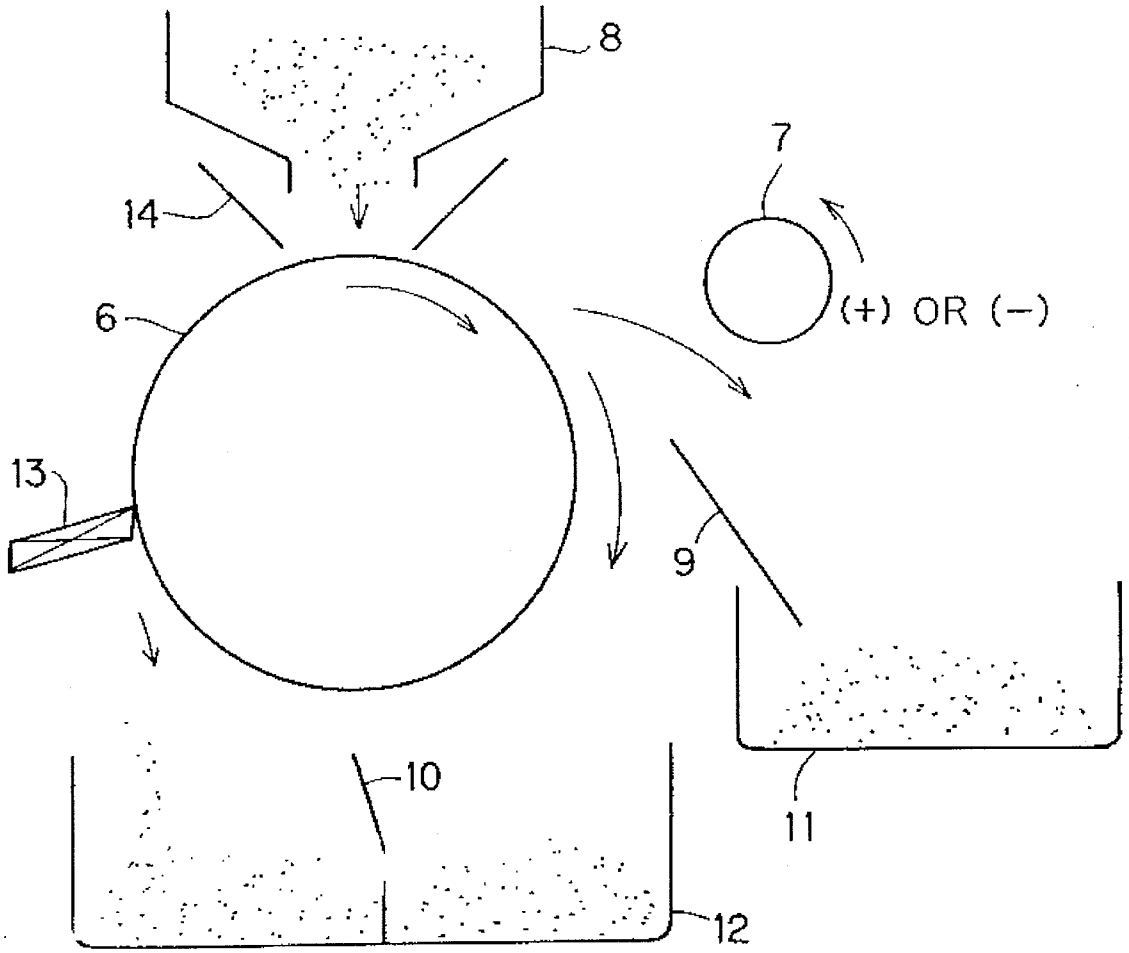

The prior art structure of FIG. 8 is disadvantageous in that a great amount of powders and/or particles are deposited on the surface of the grounded drum 6 and are thus required to be separated by using the centrifugal force generated by constantly rotating the drum 6, and that it is necessary to rotate the drum 6 and the rotary electrode 7 at a constant speed at all times in order to provide constant conditions of forces (Coulomb's force, image force, gravitational force) exerted upon the powders and/or particles of the mixture for exhibition and maintenance of the stable ability of classification, which adds to electricity rates.

On the other hand, the second preferred embodiment of the present invention is designed such that the endless belts 61, 62 cover the opposite surfaces of the electrodes 55, 56 and the charged powders and/or particles are dropped into the electrostatic field generated between the endless belts 61 and 62 lying between the electrodes 55 and 56, which does not cause the powders and/or particles to be deposited in a great amount on the electrodes 55, 56. Therefore, there is no need to rotate the electrodes 55, 56, eliminating the problem of increased electricity rates.

Similar to the first preferred embodiment, the endless belts 61, 62 need not be continuously fed but may be driven for feeding at regular intervals each time the fine powder and dust are accumulated if the speed of deposition of the fine powder and dust is not very high. Further, the deposit scratching members 68, 69 may be suitably positioned.

While the invention has been shown and described in detail, the foregoing description is in all aspects illustrative and not restrictive. It is therefore understood that numerous modifications and variations can be devised without departing from the scope of the invention.

What is claimed is:

1. An apparatus for separating and classifying powders and/or particles by using different fall positions depending upon difference in polarity of said powders and/or particles which are charged, said apparatus comprising:

a pair of spaced electrodes for producing an electrostatic field therebetween;

a pair of insulative endless belts covering respective opposite surfaces of said electrodes, said belts being opposed to each other and fed in circulation; and a pair of deposit scratching members remote from a position in which the electrostatic field produced between said electrodes works and contacting outer surfaces of said endless belts throughout their width, respectively;

a pair of support frames, each of said support frames carrying one of said pair of electrodes, one of said pair of endless belts, and one of said pair of scratching members, one of said support frames being a movable frame adapted for movement toward and away from the other said support frame.

2. The apparatus of claim 1, further comprising:

a material-to-be-classified supply mechanism for supplying said powders and/or particles to a portion over said electrodes; and a recovery container for collecting said powders and/or particles under said electrodes.

3. The apparatus of claim 2, further comprising:

drive mechanisms for feeding said endless belts in circulation in predetermined directions, respectively.

4. The apparatus of claim 3, wherein said electrodes are of a vertically elongated flat plate type.

5. The apparatus of claim 4, wherein said deposit scratching members are in contact with portions of said endless belts in which said outer surfaces of said endless belts face downward.

6. The apparatus of claim 5, wherein said deposit scratching members are in pressure contact with said endless belts from below said endless belts.

7. The apparatus of claim 2, wherein said opposite surfaces of said electrodes are slightly spaced apart from said endless belts, respectively.

8. The apparatus of claim 1, wherein said endless belts have an insulation resistance of not less than 100 MΩcm.

9. The apparatus of claim 1 wherein said movable frame moves along a guide rail.

10. The apparatus of claim 9 wherein said movable frame has wheels which are adapted to roll on said guide rail.

* * * * *